US011006785B2

(12) United States Patent
Al Hamli

(10) Patent No.: US 11,006,785 B2
(45) Date of Patent: May 18, 2021

(54) POWERED SCRUBBING, TELESCOPING DEVICE

(71) Applicant: Mossab M. M. J. Al Hamli, Safat (KW)

(72) Inventor: Mossab M. M. J. Al Hamli, Safat (KW)

( * ) Notice: Subject to any disclaimer, the term of this patent is extended or adjusted under 35 U.S.C. 154(b) by 21 days.

(21) Appl. No.: 16/846,837

(22) Filed: Apr. 13, 2020

(65) Prior Publication Data

US 2020/0288919 A1 Sep. 17, 2020

Related U.S. Application Data

(63) Continuation-in-part of application No. 16/351,462, filed on Mar. 12, 2019, now abandoned.

(51) Int. Cl.

| | |
|---|---|
| ***A47K 7/04*** | (2006.01) |
| ***A46B 13/02*** | (2006.01) |
| ***B25F 5/02*** | (2006.01) |
| *A47K 7/02* | (2006.01) |
| *A46B 9/06* | (2006.01) |

(52) U.S. Cl.
CPC ..... *A47K 7/043* (2013.01); *A46B 13/02* (2013.01); *B25F 5/02* (2013.01); *A46B 9/06* (2013.01); *A46B 2200/1006* (2013.01); *A47K 7/028* (2013.01)

(58) Field of Classification Search
CPC ..... A47K 7/028; A47K 7/04; A47K 7/043; A47L 11/12; A47L 11/16; A47L 11/164; A47L 11/206; A47L 11/2065; A47L 11/2025; A47L 11/283; A47L 11/293; A47L 11/4038; A46B 13/02; A46B 13/008
See application file for complete search history.

(56) References Cited

U.S. PATENT DOCUMENTS

D471,365 S 3/2003 Henrie
2006/0285910 A1* 12/2006 Khubani ..... A46B 11/0062 401/6

(Continued)

FOREIGN PATENT DOCUMENTS

| | | |
|---|---|---|
| CH | 697607 B1 | 12/2008 |
| CN | 202044189 U | 11/2011 |
| GB | 2541254 A | 2/2017 |

OTHER PUBLICATIONS

"KEDSUM Rechargeable Conic Face Cleaning Brush," 1996-2019 Amazon.com, Inc.

*Primary Examiner* — Laura C Guidotti
*Assistant Examiner* — Aaron R McConnell
(74) *Attorney, Agent, or Firm* — Nath, Goldberg & Meyer; Richard C. Litman

(57) ABSTRACT

The powered scrubbing device with telescoping handle includes a handheld, battery-powered scrubbing device having a telescoping handle. The battery powers a motor that drives a reciprocator, which provides linear reciprocating motion to an attached sponge or brush. The reciprocating speed may be controlled by a user through a button on a body of the device. A scrubbing pad may be removably attachable so it can be replaced when worn out or when a user requires a scrubbing pad having different scrubbing characteristics. The telescoping handle may be extended for accessing hard to reach places with the scrubbing device.

4 Claims, 14 Drawing Sheets

(56) References Cited

U.S. PATENT DOCUMENTS

| | | | | |
|---|---|---|---|---|
| 2013/0060176 | A1* | 3/2013 | Nichols | A61H 23/02 601/137 |
| 2015/0342422 | A1* | 12/2015 | Firestone | A47K 7/03 15/104.8 |
| 2017/0112333 | A1* | 4/2017 | McCauley | A47K 7/043 |
| 2020/0001329 | A1* | 1/2020 | Brennan | A46B 13/02 |
| 2020/0187635 | A1* | 6/2020 | Akridge | A46B 13/023 |

* cited by examiner

POWERED SCRUBBING, TELESCOPING DEVICE

CROSS-REFERENCE TO RELATED APPLICATIONS

This application is a continuation-in-part of U.S. patent application Ser. No. 16/351,462, filed on Mar. 12, 2019.

BACKGROUND

1. Field

The present disclosure relates generally to powered personal hygienic appliances, and more particularly to a powered scrubbing, telescoping device that is a small, battery-powered, waterproof, lightweight, scrubbing appliance.

2. Description of the Related Art

Many people, including the elderly and disabled, have difficulty reaching much of their body for cleaning due to a lack of strength or flexibility. A wide variety of body brushes and back scrubbers are commercially available to combat this problem. These items generally consist of an extended handle attached to a cleaning head. The cleaning head is typically a mesh cloth, a sponge or a soft brush and is arranged to scrub areas of one's body by manual manipulation of the entire device. However, many people with limited flexibility, strength and/or movement, such as by virtue of a debilitating physical condition, find these cleaning products difficult to use. In addition, these products may drastically increase cleaning time, thus resulting in unnecessary fatigue. Furthermore, current powered body brushes are large and heavy, making using and transporting the brush quite difficult.

Thus, a powered scrubbing, telescoping device solving the aforementioned problems is desired.

SUMMARY OF THE INVENTION

The powered scrubbing, telescoping device includes a handheld, battery-powered scrubbing device having a telescoping handle. The battery powers a motor that drives a reciprocator, which provides linear reciprocating motion to an attached sponge or brush. The reciprocating speed may be controlled by a user through a button on a body of the device. A scrubbing pad may be removably attachable so it can be replaced when worn out or when a user requires a scrubbing pad having different scrubbing characteristics. The device may have an integral or attachable telescoping handle that may be extended for accessing hard to reach places with the scrubbing device.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The powered scrubbing, telescoping device includes an embodiment of a handheld, battery-powered scrubbing device having an attachable telescoping handle accessory and an embodiment of a handheld, battery-powered scrubbing device having an integral, built-in telescoping handle. The battery powers a motor that drives a reciprocator, which provides linear reciprocating motion to an attached sponge or brush. The reciprocating speed may be controlled by a user through a button on a body of the device. A scrubbing pad may be removably attachable so that it can be replaced when worn out or when a user requires a scrubbing, pad having different scrubbing characteristics. The telescoping handle may be attached for accessing hard to reach places with the scrubbing device.

Figure 1:
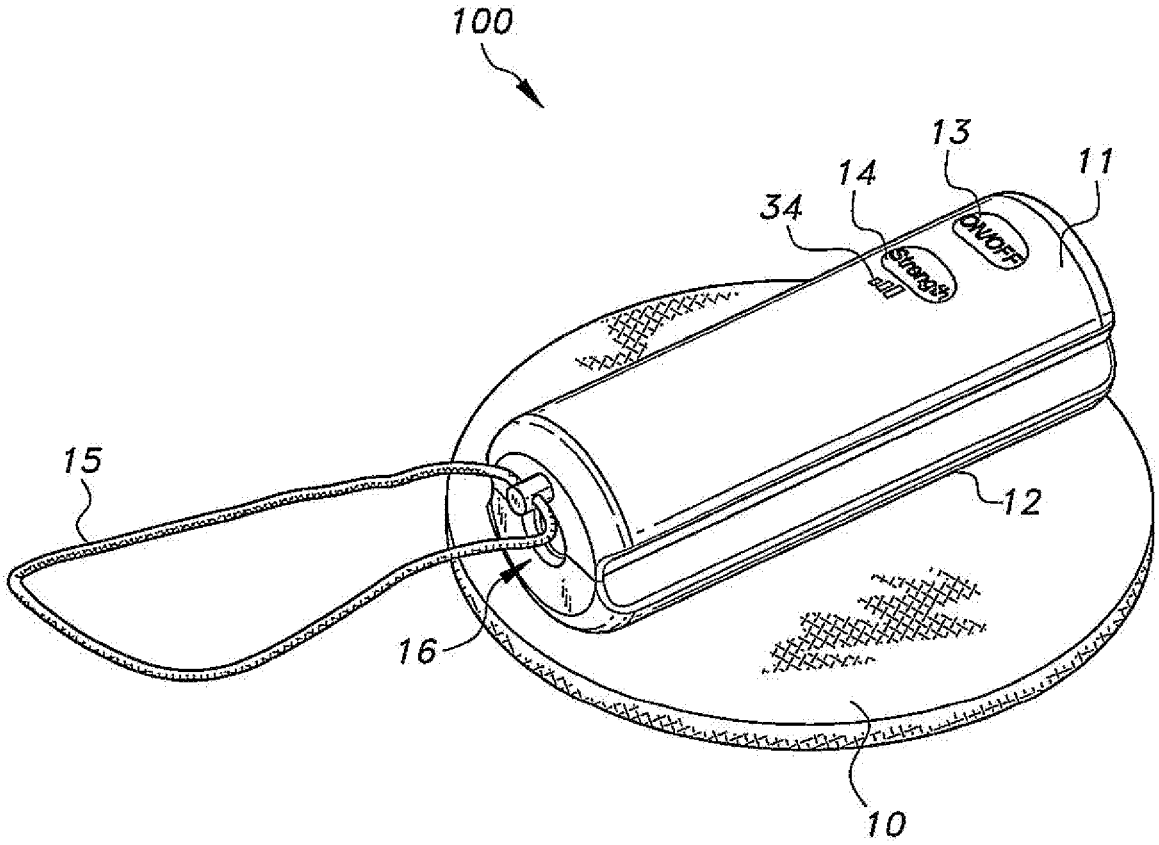
FIG. 1 is a perspective view of a first embodiment of a powered scrubbing device, the telescoping handle being detached.
Figure 2:
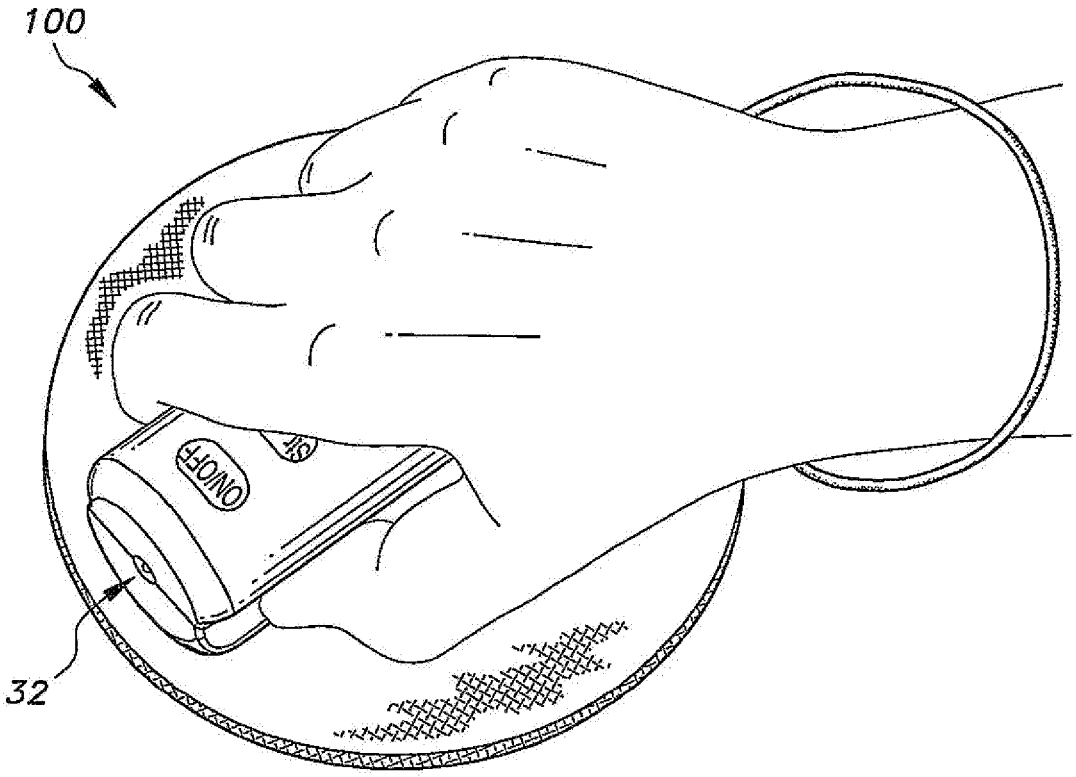
FIG. 2 is an environmental perspective view of the powered scrubbing device of FIG. 1, shown being, held by a user.

FIGS. 1 and 2 show an exemplary powered scrubbing device 100. As seen in FIG. 1, the scrubbing device 100 includes an outer shell having an upper component 11 and lower component 12, which define a generally cylindrical shape that is dimensioned and configured far being gripped and manipulated by one hand of the user. Grooves run along the length of the outer shell to accept the user's fingertips for enhancing grip. The outer shell may be made of rigid rubber, plastic, or metal. For example the shell may be made from such materials as polyvinyl chloride (PVC), polyethylene (PE), polypropylene, and/or silicone. Since the device 100 may be used by the elderly or people with disabilities, who may have trouble gripping objects, the shell may include a high friction or anti-slip coating. In addition, a safety loop 15 may be attached to a proximal end of the outer shell for looping around the user's wrist. The loop 15 will catch the scrubbing device 100 if it is accidentally dropped, thus preventing it from falling to the ground.

The top component 11 of the outer shell includes two buttons 13, 14. The first button 13 may act as an on/off toggle switch for a reciprocator housed within the outer shell, and the second button 14 may adjust the reciprocating speed. A scrubbing pad 10 is attached to scrubbing pad mounting member 21 at the output of the reciprocator. The scrubbing pad mounting member 21 extends out of a channel 30 defined in the bottom portion 12 of the shell. The largest dimension of the scrubbing pad 10 may be larger than the largest dimension of the outer shell.

Figure 3:
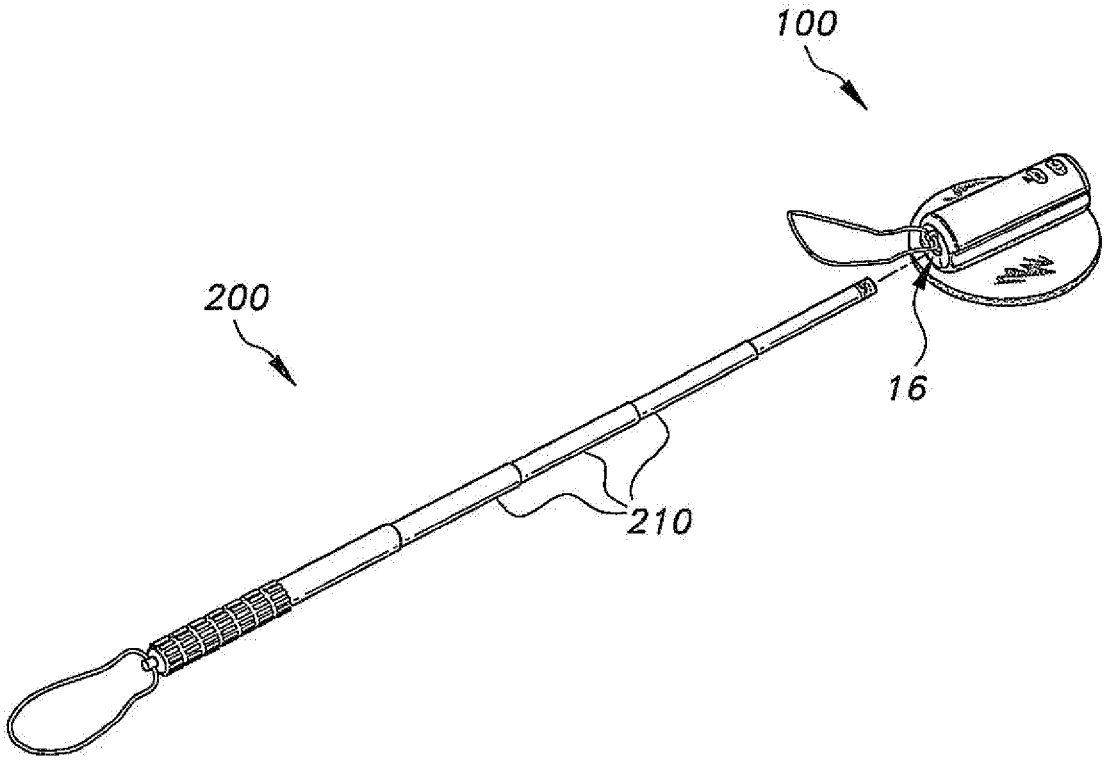
FIG. 3 is a perspective view of the powered scrubbing device of FIG. 1, shown with a detachable telescoping handle being attached to the device.

FIG. 3 shows the scrubbing device 100 with a telescoping handle accessory 200. The telescoping handle 200 may be connected to the scrubbing device through a receiving hole 16 defined in an end of the shell. As seen in FIG. 3, a longitudinal axis of the handle 200 may be aligned with the longitudinal axis of the outer shell. By aligning the axis of the handle 200 with reciprocating plane of the resilient member 10, the device 100 will be easier to control from the handle 200. The handle 200 may be attached to the receiving hole 16 using a threaded connection. Alternatively, other connections in the art may be used for attaching the handle 200 and outer shell. The telescoping portion of the handle 200 may include multiple tapered, concentric members 210 that slide in and out of each other. Other, members known in the art to have an adjustable length may alternatively be used in the handle 200.

Figure 4:
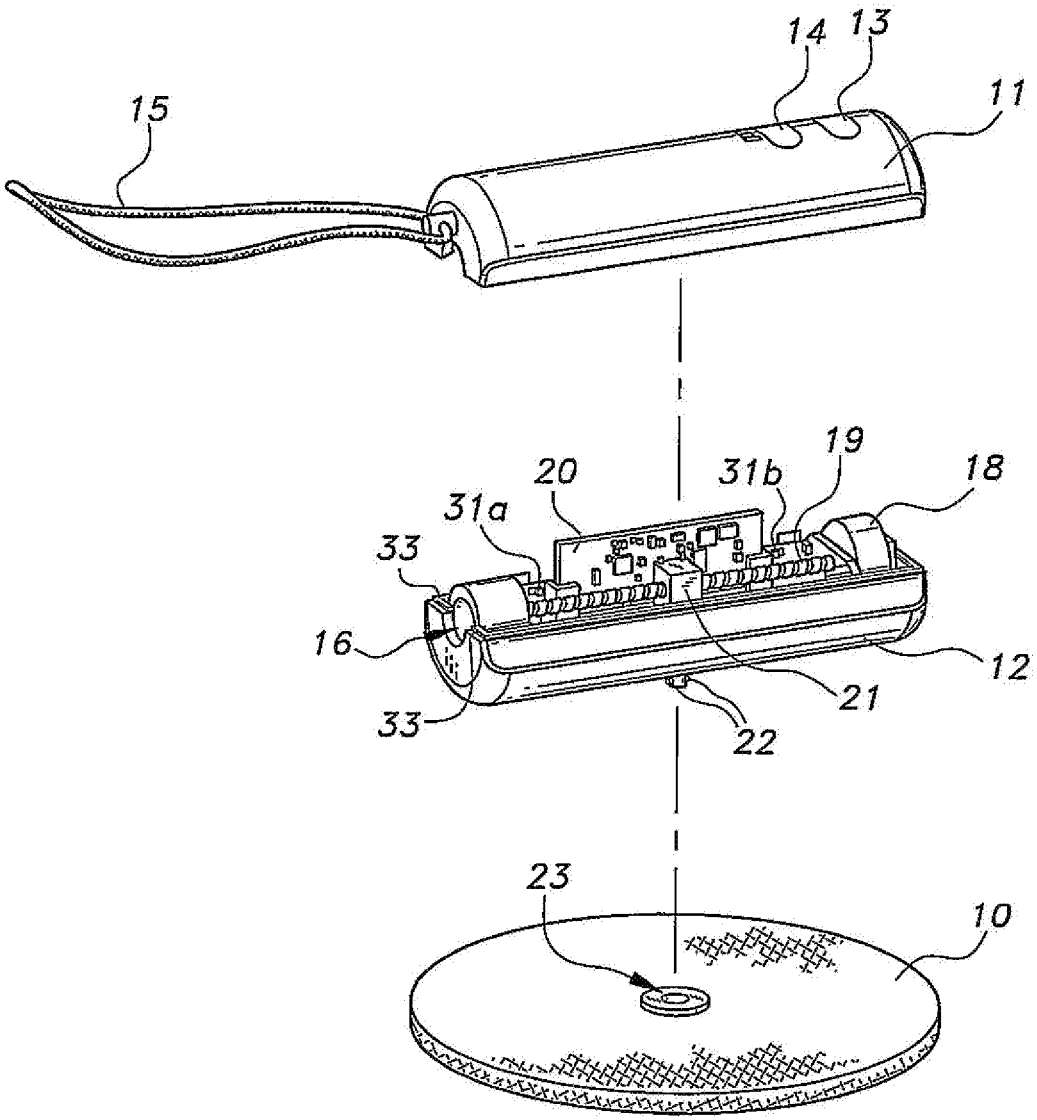
FIG. 4 is a partially exploded perspective view of the powered scrubbing device of FIG. 1.

FIG. 4 shows a partially exploded view of the scrubbing device 100 with the upper component 11 of the outer shell removed from the lower component 12 to show the elements of the reciprocator. An opening in the scrubbing pad mounting member 21 is threadably engaged with a threaded shaft 19. The threaded shaft 19 is secured to the lower component 12 of the outer shell at one end in a bearing that permits axial rotation. An opposing end of the threaded shaft 19 is attached to the output shaft of a motor 18, which is also secured to the lower component 12 of the outer shell. Rotating the motor 18 causes the threaded shaft 19 to rotate in place, since it is secured at both ends. A lower portion of the scrubbing pad mounting member 21 extends through the channel 30 defined in the bottom of the lower component 12 of the outer shell. The channel 30 walls counteract rotary forces provided by the threaded member 19, resulting in the scrubbing rod mounting member 21 remaining in a vertical orientation. The threaded connection between the threaded shaft 19 and the scrubbing pad mounting member 21 causes the mounting member 21 to be translated along the length of the threaded shaft 19 when the threaded shaft 19 is rotated. Rotating the motor 18 and the attached threaded shaft 19 in a first direction causes the scrubbing pad mounting member 21 to translate along the threaded shaft 19 away from the motor 18, and rotating the motor 18 in a second, opposite direction causes the scrubbing pad mounting member 21 to translate along the threaded shaft 19 towards the motor 18. The reciprocating motion of the scrubbing pad mounting member 21 is produced by repeatedly operating the motor 18 in opposite directions for short periods of time. A center of the reciprocating range of motion may be aligned with a center of the outer shell in order to maximize the range of motion.

The motor 18 may be controlled by a controller 20 (which may be a conventional motor control circuit having power controlled by the toggle switch 13 and speed control in discrete increments controlled by toggle switch 14) that is in communication with the buttons 13, 14, the motor 18, and switches or sensors that detect the position of the scrubbing pad mounting member 21. The controller 20 may produce reciprocating motion using two limit switches 31*a*, 31*b*. One switch 31*a*, 31*b* may be located at each end of the reciprocating range of the threaded shaft 19, at a position where it may be contacted by the scrubbing pad mounting member 21. When, the mounting member 21 hits the switch 31*a* or 31*b*, the switch 31*a* or 31*b* will send a signal to the controller 20, which indicates a change in motor direction, thus moving the scrubbing pad mounting member 21 away from the switch. Accordingly, the scrubbing pad mounting member 21 will operate in a reciprocating motion any time the motor 18 is operating. Other methods known in the art may be used to operate the motor in a reciprocating manner. For example, a stepper motor or a microcontroller may be used, which determines a change in motor direction based on a predetermined amount of rotations.

Figure 5:
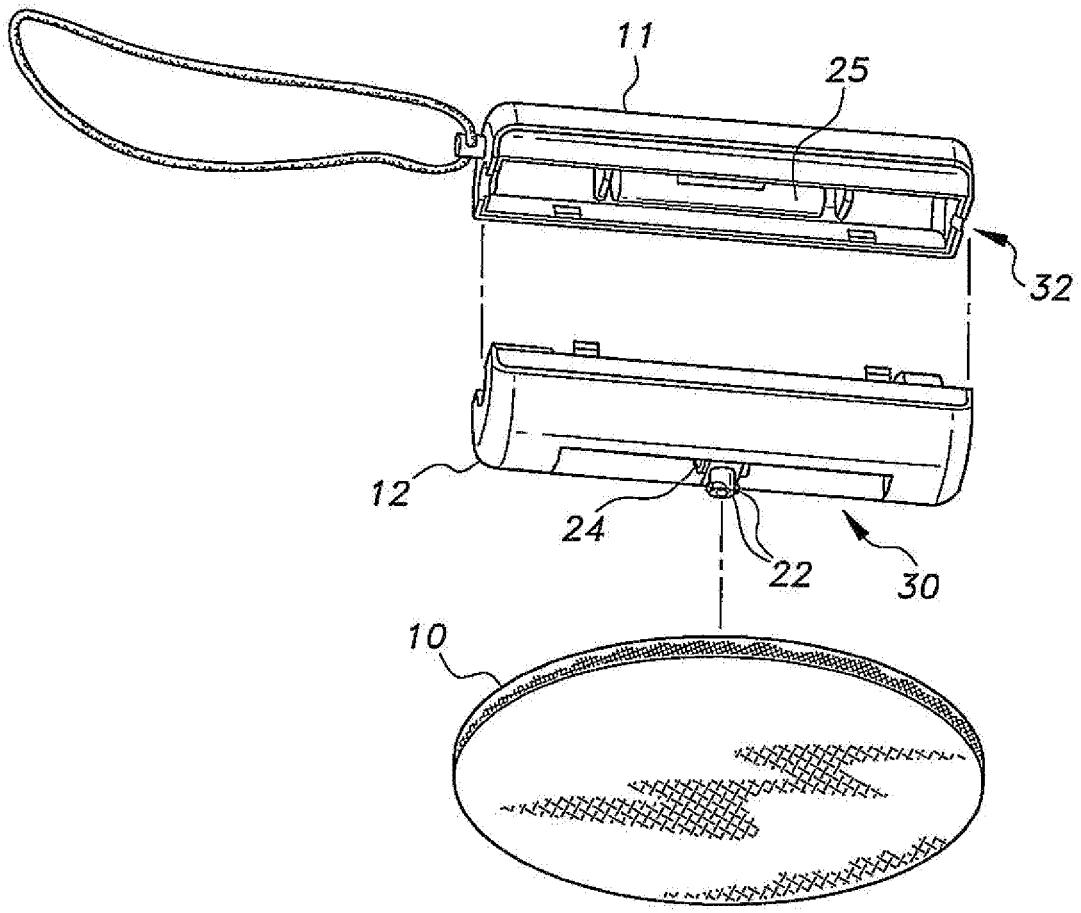
FIG. 5 is another partially exploded view of the powered scrubbing device of FIG. 1, as seen from the bottom.

FIG. 5 shows a partially exploded view of the scrubbing device 100 with the upper 11 and, lower 12 components of the outer shell separated and the scrubbing pad 10 removed from the scrubbing pad mounting member 21. As seen in FIG. 5, the battery 25 is housed in the upper component 11 of the outer shell. The battery 25 powers all components of the reciprocator, including, but not limited to, the motor 25, the controller 20, buttons 13, 14, switches 31*a*, 31*b*, and/or sensors. The battery 25 may be rechargeable. The end of the outer shell opposite the receiving hole 16 for the handle defines an opening 32, which houses a charging port. Accordingly, to recharge the battery, a user may insert a charging adapter into the port. A battery power meter 34 may be included on the outer shell to indicate the remaining battery life to the user.

The shell provides a water-resistant or waterproof barrier to prevent the internal components from being exposed to water. Accordingly, a gasket 33 may be positioned between the upper 11 and lower 12 outer shell portions to create a watertight seal between the portions 11, 12. Additional gaskets may be used around the opening 32 for the charging port and the receiving hole 16 for the handle 200. Buttons providing a watertight seal may be used for the power button 13 and speed adjustment button 14.

A watertight mechanism may also be used to prevent water from entering through, the channel 30 from which the scrubbing pad mounting member 21 extends. For example, a flexible, waterproof membrane may be sealed around the perimeter of the channel opening with an opening in the center of the membrane sealed around the scrubbing pad mounting member 21. When the scrubbing pad mounting member 21 reciprocates, the membrane will stretch to compensate for the movement and maintain the watertight seal. A loosely fitting, membrane may be used so that the reciprocating motion mainly pulls the membrane taut instead of stretching it. Alternatively, flexible flaps may extend down each long side of the channel 30. The flaps may be configured so that their terminal ends are contacting in order to create a watertight seal between the flaps. The scrubbing pad mounting member 21 will extend down in-between the flaps and reciprocate back and forth at the junction between the flaps. This may be considered water-resistant. Alternatively, a center plate may be secured around the scrubbing pad mounting member 21 with a watertight seal between the mounting member 21 and the plate. Multiple stacked plates, connected to each other by tracks, can be located on either side of the mounting member 21. The plate at the top of the stack is connected to an end of the shell, and the plate at the bottom of the stack is attached to the center plate. Other mechanisms known in the art for maintaining a watertight seal around a reciprocating member may be used.

Figure 6:
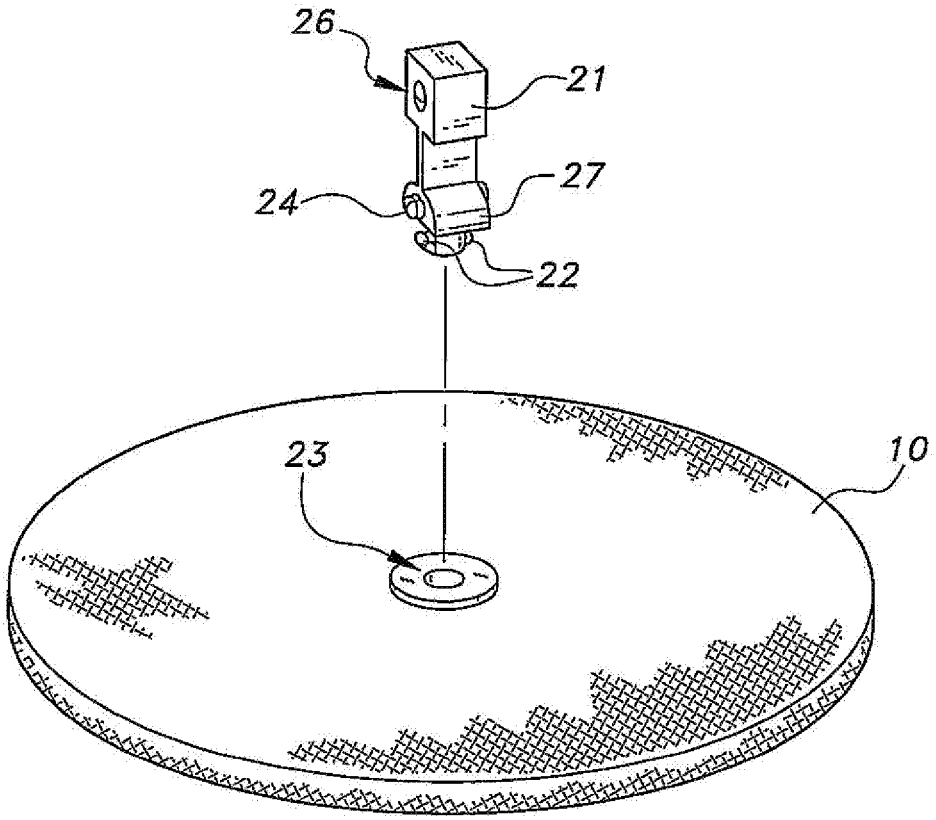
FIG. 6 is an exploded perspective view, showing only a replacement scrubbing pad and a scrubbing pad mounting member of the power scrubbing device of FIG. 1.

FIG. 6 shows an exploded view of the scrubbing pad 10 and the scrubbing pad mounting member 21. The upper end of the mounting member 21 includes a through-hole 26 for accepting the threaded shaft 19. The middle portion of the mounting member 21 may have a thin width so that only a small width channel 30 is necessary to allow the mounting member 21 to extend through the outer shell 12. The lower portion 12 of the outer shell, will defined a recessed area (see FIG. 5) at the mouth of the channel 30 to act as a track for the lower end of the mounting member 21. Accordingly, the recess in the shell 12 may be shaped to match the outer shape of the U-shaped surface 27 at the bottom of the mounting member 21. As a result, stability of the mounting member 21 will be maintained through contact with the recess. Bearing material may be added to the mounting member 21 and/or recess to extend service life, and decrease friction.

The scrubbing, pad mounting member 21 shown in FIG. 6 provides an attachment mechanism for attaching the scrubbing pad 10. The mechanism includes two spring-loaded detent pins 22 on opposing sides of the mounting member 21 at its bottom. When the mounting member 21 is inserted into the receptacle 23 of the scrubbing pad 10, the pins 22 snap into detent holes formed inside the sidewall of the receptacle 23. By snapping into the holes, the detent pins 22 prevent axial and rotational movement of the scrubbing pad 10 relative to the mounting member 21, thus securing the two together. To remove the scrubbing pad 10, a user may push in on two release buttons 24 that will retract the detent pins 22 and allow the mounting member 21 to be removed from the receptacle 23 of the scrubbing pad 10. Other methods known in the art for attaching the scrubbing pad 10 to the mounting member 21 may also be used. For example, a threaded connection.

The scrubbing device 100 may be used with many different types of scrubbing pads 10. Some examples of scrubbing pad types may include sponges, brushes, scouring pads, and abrasive pads. Additionally, scrubbing pads of the same type but different textures may be used. For example, brushes with different sized bristles may be used for different cleaning procedures or portions of the body.

Figure 7A:
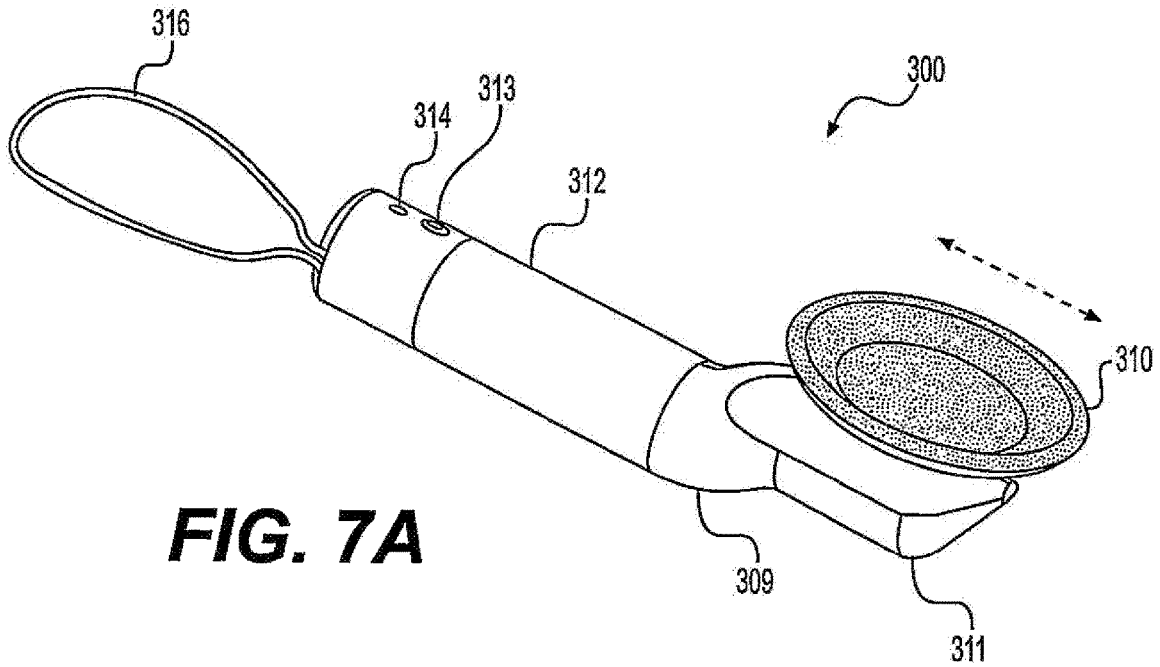
FIG. 7A is a perspective view of a second embodiment of a powered scrubbing, device, shown with the telescoping handle in a retracted state.
Figure 7B:
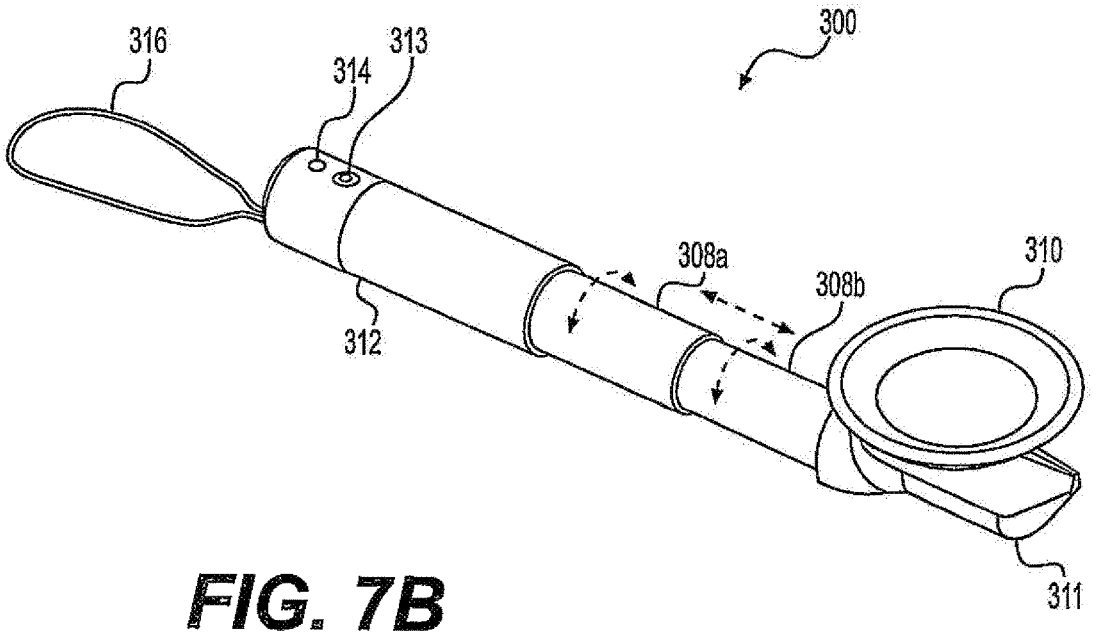
FIG. 7B is a perspective view of the powered scrubbing device of FIG. 7A, shown with the telescoping handle extended.

FIGS. 7A-10 show a second embodiment of a scrubbing device 300. As seen in FIG. 7A, the scrubbing device 300 includes a body 309 defining a cylindrical grip 312 and a scrubbing end 311. As seen in FIG. 7B, the grip 312 may be connected to the scrubbing end 311 by multiple concentric tubular members 308*a*, 308*b*, which provide for telescopic lengthening of the scrubbing device 300. In some embodiments, a twisting motion of the grip 312 may extend the tubular members 308*a*, 308*b* to lengthen the scrubbing device 300. The grip 312 may support a first button 313 and a second button 314. The first button 313 may act as an on/off toggle switch for the reciprocator housed within the body 309, and the second button 314 may adjust the reciprocating speed. A scrubbing pad 310 or other cleaning accessory may be removably attached to the scrubbing end 311 of the body 309. A safety loop 315 may be attached to the grip 312 for looping around the user's wrist.

The body 309 of the scrubbing device 300 may be made from a rigid polymer so that the device 300 maintains its form when exposed to the forces involved with scrubbing, as well as when it is dropped on hard surfaces. An outer layer of the body 309 may have an anti-shock coating made from rubber or silicone. The outer layer may also provide a high friction surface to enhance a user's grip of the scrubbing device 300 in wet, soapy environments. The body 309 may provide a watertight barrier to prevent water from accessing the internal components.

Figure 8A:
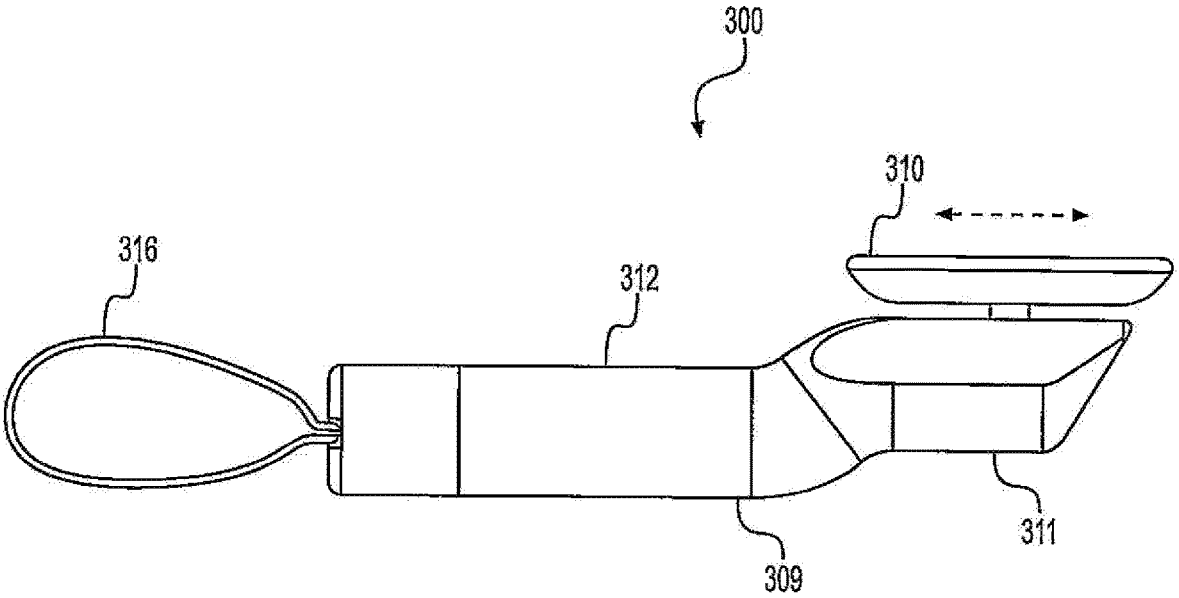
FIG. 8A is a side view of the powered scrubbing device of FIG. 7A.

FIG. 8A shows the reciprocating motion path that may be imparted to the scrubbing pad 310. The reciprocator may reciprocate the scrubbing pad 310 along a length of the body 309.

Figure 8B:
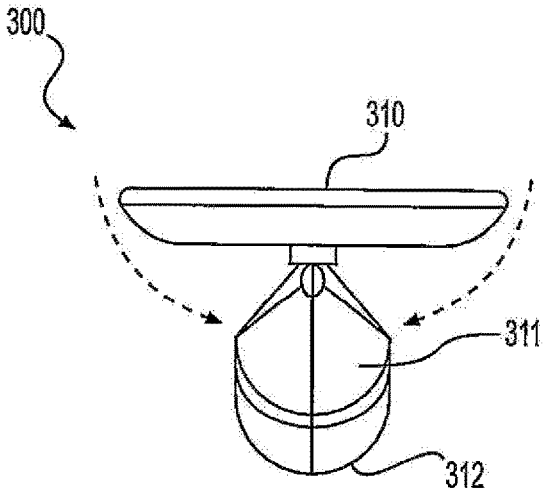
FIG. 8B is a front view of the powered scrubbing device of FIG. 7A.

FIG. 8B shows the relation between the scrubbing pad 310 and the scrubbing end 311. The scrubbing pad 310 may be configured on the body 309 to allow for greater flexion of the scrubbing pad 310 during use. For example, when scrubbing an armpit, the scrubbing end 311 allows the pad 310 to flex down for following the U-shaped contour of the armpit.

Figure 9:
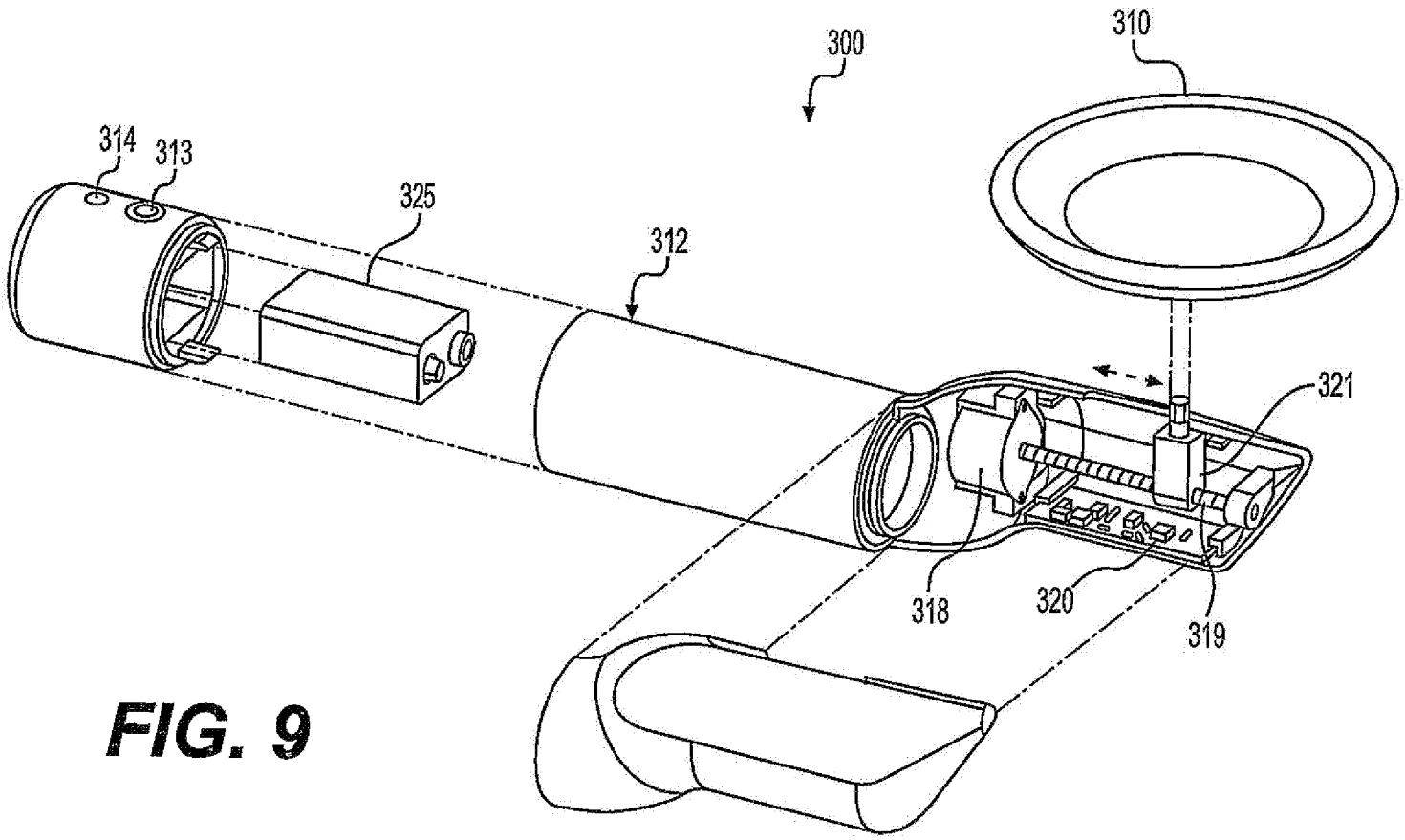
FIG. 9 is an exploded perspective view of the powered scrubbing device of FIG. 7A.

FIG. 9 shows the internal components of the scrubbing device 300. The reciprocating mechanism may be similar to the reciprocating mechanism of scrubbing device 100. A scrubbing pad mounting member 321 may be threadably engaged with a threaded shaft 319 that is connected to the output of a motor 318. The motor 318 may rotate in opposite directions to move the scrubbing pad mounting member 321 in a reciprocating motion. A controller 320 may control operation of the motor 318 based on inputs from the first 313 and second buttons 314. A battery 325 may be housed in the grip 312 for powering the motor 318. The battery 325 may be a rechargeable battery, such as a lithium-ion battery. The scrubbing pad 310 may be removably attached to the scrubbing pad mounting member 321 using any method known in the art, such as the attachment mechanism shown in FIG. 6.

Figure 10:
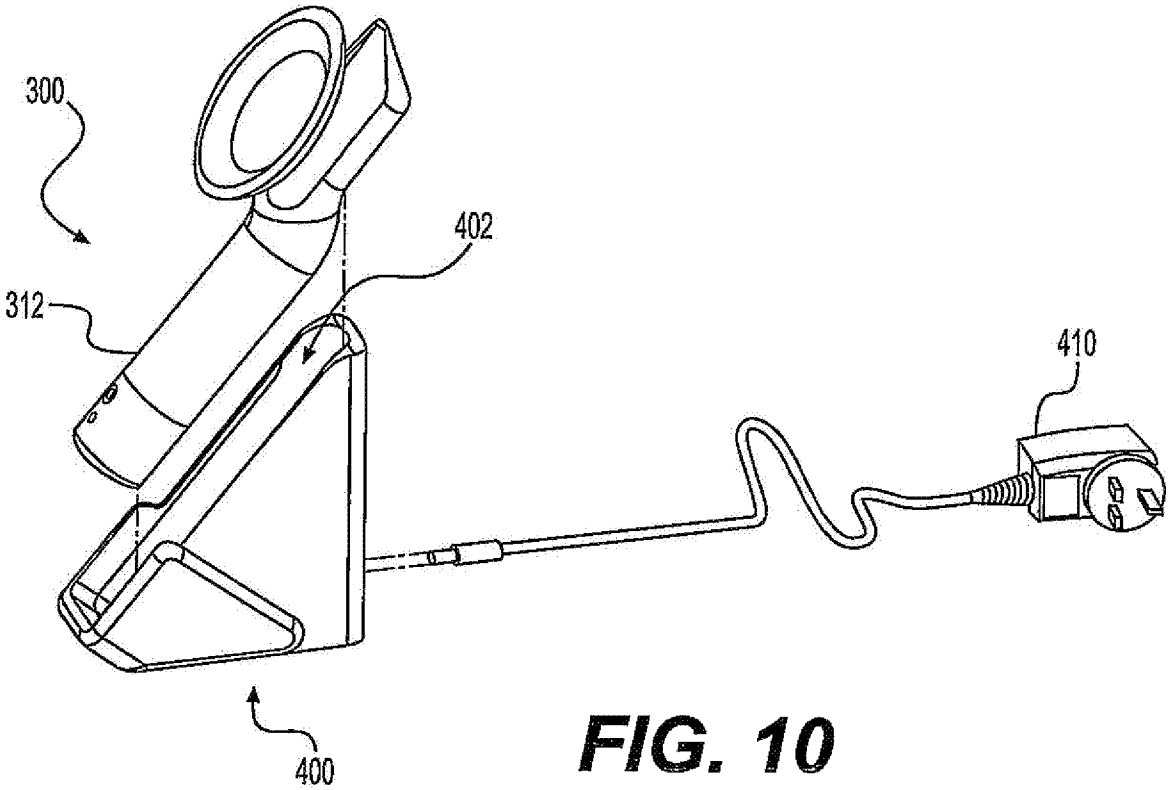
FIG. 10 is an exploded perspective view of the powered scrubbing device of FIG. 7A being attached to a recharging dock.
Figure 11A:
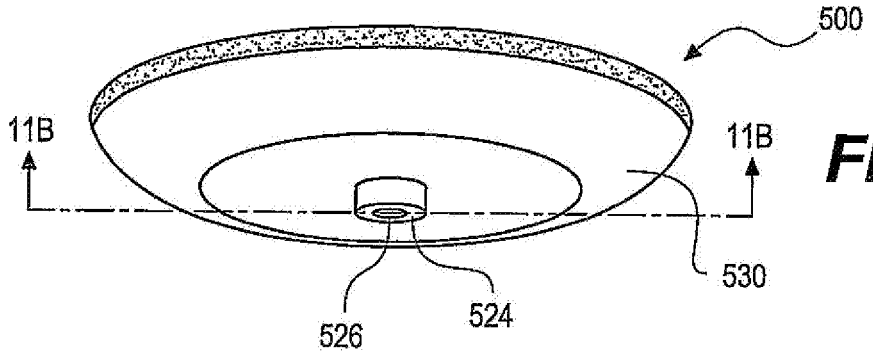
FIG. 11A is a perspective view of a loofah pad for attachment to a powered scrubbing device.
Figure 11B:
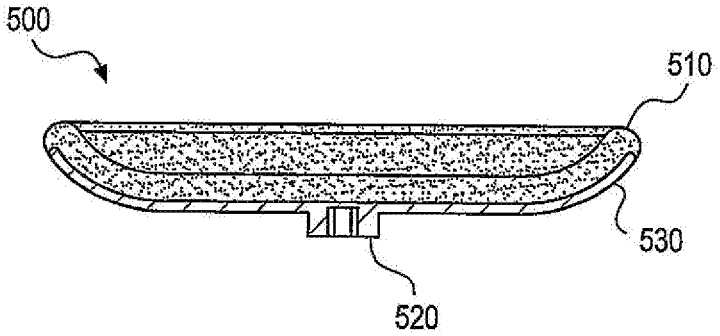
FIG. 11B is a section view drawn along lines 11B-11B of FIG. 11A.
Figure 11C:
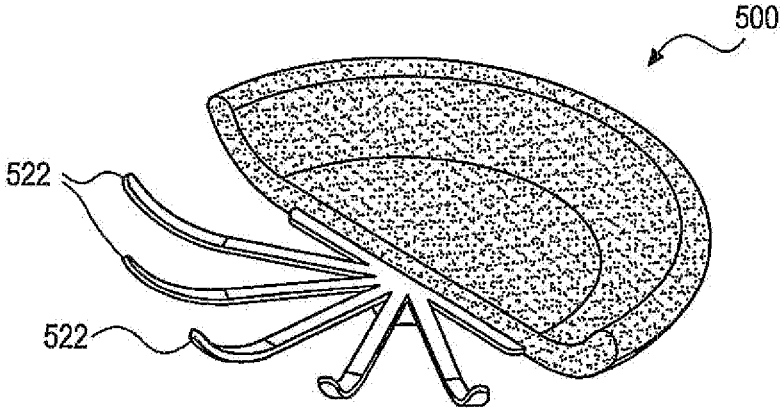
FIG. 11C is a perspective view of the loofah pad assembly of FIG. 11A, shown with the pad broken away and partially in section to show the silicon base.
Figure 11D:
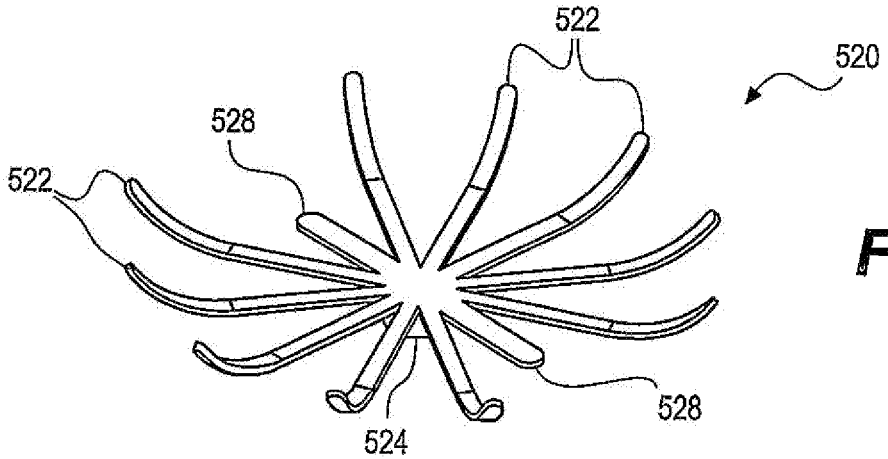
FIG. 11D is a perspective view of the silicon base supporting the loofah pad of FIG. 11A.

FIG. 10 shows a charging dock 400 that may be used for recharging the battery 325 of, the scrubbing device 300. The dock 400 may include a docking port 402 for accepting and securing the grip 312 of the scrubbing device 300. A magnetic connection may be provided between the scrubbing device 300 and the charging dock 400 to further secure the two. When docked in the docking port 402, two electrodes on the scrubbing device 300 may contact two electrodes on the charging dock 400 to provide an electrical connection between the battery 325 and dock 400. A power cord 410 may be plugged into the charging dock 400 for transmitting power from a wall outlet to the dock 400. The charging dock 400 may be water-resistant for use in a wet environment and/or for accepting a wet scrubbing device 300.

FIGS. 11A-11D show a scrubbing pad 500 that may be mounted on the scrubbing end 311 of the device 300. The scrubbing pad 500 may include a concave scrubbing layer 510 supported by a fingered spine base 520. The spine base 520 may include ten radially extending fingers 522, which support the scrubbing layer 510 while allowing the scrubbing pad 500 to conform to the contours of a human body. The fingers 522 may be made from a resilient flexible material, such as silicone. A central hub 524 of the spine may form a connection port 526 for connection to the scrubbing pad mounting member 321. The central hub 524 may be made from a rigid material, such as polyethylene, to securely hold the scrubbing pad 500 in place under variable scrubbing speeds and pressures. Two diametrically opposed stabilizing members 528 may extend radially outwards from the central hub 524. Half of the fingers 522 may extend out from one side of the stabilizing members 528 and the other half of the fingers 522 may extend out from the opposing side. When attached to the mounting member 321, the stabilizing members 528 may be aligned with the length dimension of the scrubbing device 300. By aligning the stabling members 528 with the length dimension of the scrubbing device 300, the fingers 522 are positioned for supporting the scrubbing layer 510 when it is flexed around the scrubbing end 311 during use. A shell 530 may cover the bottom of the scrubbing layer 510 and spine base 520.

Figure 12A:
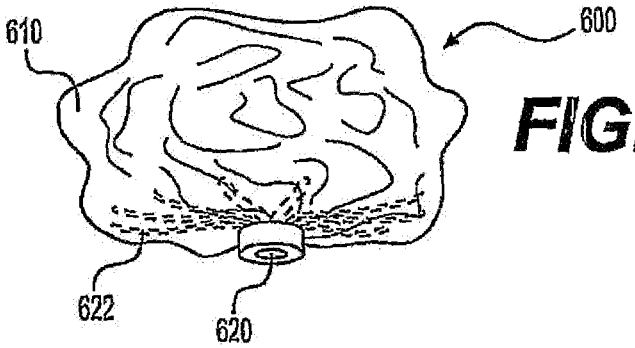
FIG. 12A is a perspective view of a mesh 'pouf' loofah for mounting on the powered scrubbing device.
Figure 12B:
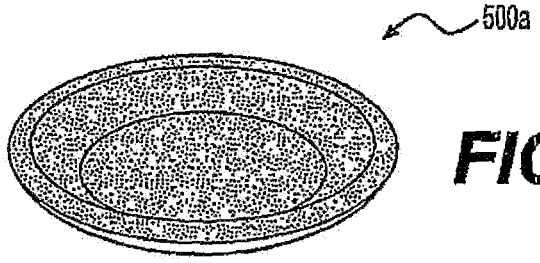
FIG. 12B is a perspective view of a soft textured loofah pad for the powered scrubbing device.
Figure 12C:
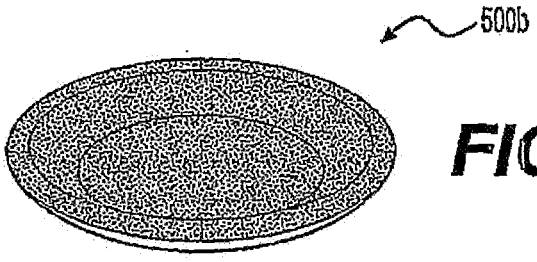
FIG. 12C is a perspective view of a medium-textured loofah pad for the powered scrubbing device.
Figure 12D:
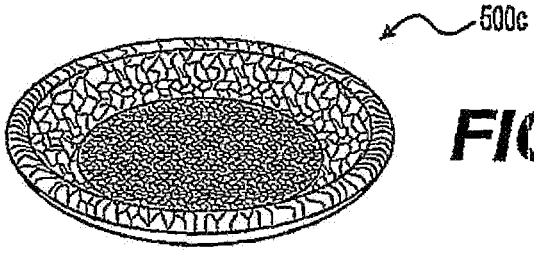
FIG. 12D is a perspective view of a coarse-textured loofah pad for the powered scrubbing device.
Figure 12E:
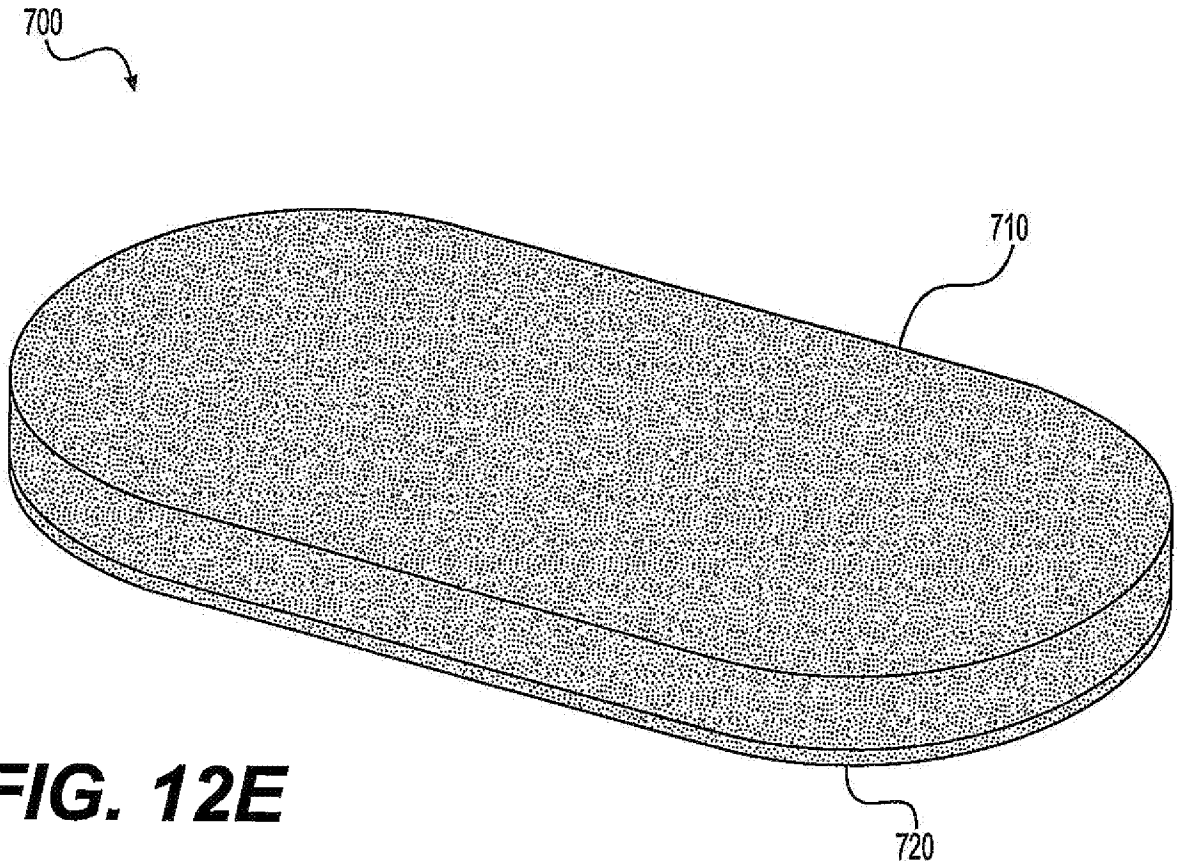
FIG. 12E is a perspective view of a foot pumice stone attachment for the powered scrubbing device.
Figure 12F:
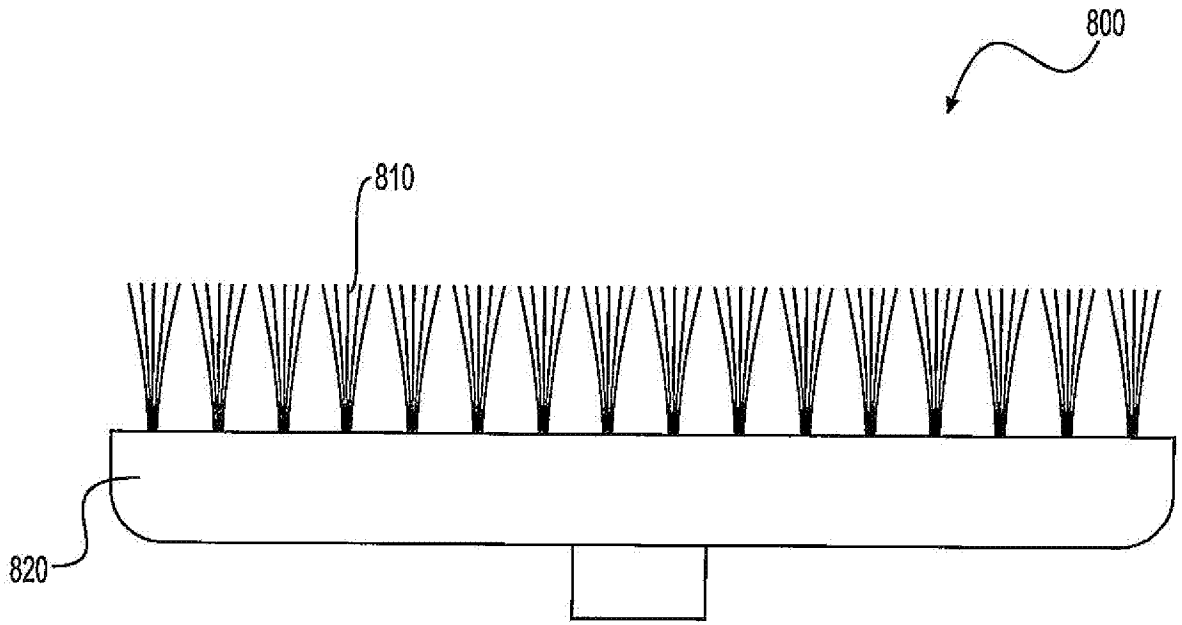
FIG. 12F is a perspective view of a foot scrubbing brush attachment for the powered scrubbing device.

FIGS. 12A-12F show an embodiment of a kit of varying scrubbing pads 500*a*-500*c*, 600, 700, 800 that may be used with a scrubbing device 100, 300. FIG. 12A shows a mesh sponge embodiment of the scrubbing pad 600. The mesh sponge scrubbing pad 600 may include an upper 'pouf' mesh 610 supported by a fingered spine 620 having flexible fingers 622. The fingered spine 620 will support the 'pouf' mesh 610 in an upright position, while also allowing the 'pouf' mesh 610 to conform to the counters of the human body. FIGS. 12H-12D show three varying embodiments of the scrubbing pad 500*a*, 500*b*, 500*c* providing different degrees of exfoliation. FIG. 12B shows a soft-textured scrubbing pad 550*a*, FIG. 12C shows a medium-textured scrubbing pad 500*b*, and FIG. 12D shows a coarse-textured scrubbing pad 500*c*. FIG. 12E shows a pumice stone embodiment of the scrubbing pad 700 for removing dead skin from a user's foot. The pumice stone scrubbing pad 700 may include an upper pumice stone 710 supported by a lower base 720 having a connection port for connection to the scrubbing device 300. FIG. 12F shows a foot brush 800 for scrubbing a user's foot. The foot brush 800 may include a lower base 820 having a connection port for connecting to the scrubbing device 300, and bristles 810 extending out from the base 820.

It is to be understood that the powered scrubbing device with a telescoping handle is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject, matter.

I claim:

1. A powered scrubbing device, comprising: an elongated body, the body having a longitudinal axis and includes a cylindrical grip portion and a scrubbing end portion, the grip portion being connected to the scrubbing end portion by a plurality of concentric tubular members providing selective telescopic lengthening of the scrubbing device; a scrubbing pad mounting member disposed on the scrubbing end portion, the mounting member being adapted for attaching a scrubbing pad to the body; a scrubbing pad mounted to the scrubbing pad mounting member, the scrubbing pad includes a spine having a central hub adapted to be attached to the scrubbing pad mounting member and a plurality of fingers extending radially from the central hub, the spine further comprises two diametrically opposed planar stabilizing members extending radially from the central hub and adapted to be aligned with the longitudinal axis of the body, the stabilizing members defining a midline of the spine, further wherein one-half of the plurality of fingers extend from opposite sides of the midline of the spine; and a battery-powered reciprocating assembly mounted within the body, the scrubbing pad mounting member being attached to the reciprocating assembly for selectively reciprocating the scrubbing pad attached to the mounting member.

2. The powered scrubbing device of claim 1, wherein said body is waterproof.

3. The powered scrubbing device of claim 1, wherein said body is water-resistant.

4. The powered scrubbing device of claim 1, wherein the central hub includes a port for connection to the mounting member.

* * * * *